United States Patent [19]

Fairhurst et al.

[11] Patent Number: 4,642,944

[45] Date of Patent: Feb. 17, 1987

[54] FEEDING ABRASIVE MATERIAL

[75] Inventors: Robert M. Fairhurst, Northampton; David H. Saunders, Buckinghamshire, both of England

[73] Assignee: The British Hydromechanics Research Association, Bedford, England

[21] Appl. No.: 762,870

[22] Filed: Aug. 6, 1985

[30] Foreign Application Priority Data

Aug. 6, 1984 [GB] United Kingdom ..... 8419960

[51] Int. Cl.[4] ..... B24C 7/00

[52] U.S. Cl. ..... 51/436; 222/195; 406/137

[58] Field of Search ..... 51/263, 292, 436, 410, 51/411; 222/630, 195; 406/92, 137

[56] References Cited

U.S. PATENT DOCUMENTS

| | | | |
|---|---|---|---|
| Re. 24,716 | 10/1959 | Anselman et al. | 406/92 |
| 895,795 | 8/1908 | Sampson | 51/410 |
| 3,230,016 | 1/1966 | Gilbert et al. | 406/137 |
| 4,048,757 | 9/1977 | Kubus | 51/411 |
| 4,064,293 | 12/1977 | Nicklas | 51/411 |

FOREIGN PATENT DOCUMENTS

| | | | |
|---|---|---|---|
| 1145549 | 3/1963 | Fed. Rep. of Germany | 406/137 |

*Primary Examiner*—Roscoe V. Parker

*Attorney, Agent, or Firm*—Shapiro and Shapiro

[57] ABSTRACT

A system for supplying a slurry includes a hopper having a lower portion tapering to an outlet at its lower end. A liquid is supplied to the hopper interior along a wall of the lower portion in a direction having a horizontal component. Particulate material feeding from a main portion of the hopper into the lower portion becomes entrained in the liquid, thus forming the slurry.

12 Claims, 2 Drawing Figures

FEEDING ABRASIVE MATERIAL

Over the past few years the abrasive water jet cutting process has found many applications. Development work has been directed towards the production of high pressure jet cutting heads that give improved performance and wear characteristics. The successful abrasive water jet cutting heads that have been developed entrain the abrasive by using a high velocity water jet, or jets, to accelerate particles in a relatively low velocity fluid stream. This process obviously incurs losses but was the only practical way of producing a continuous high velocity abrasive water jet since no reliable high pressure pumps exist which are capable of handling the abrasive slurry mixture.

One recent application of entraining abrasive water jet cutting equipment has been for underground work in relatively small diameter pipes. There is at present a process for relining sewers and drains that are in a state of decay. To use this method all obstructions that may exist in the pipe must first be removed. One common obstruction is lateral connections that protrude into the main sewer. Water alone, without entrained abrasive has been tried but cutting performance is poor, in terms of speed and quality of cut, with pressures up to 1000 bar. Extensive damage can also be caused to the surrounding pipework and soil.

The abrasive water jet cutting method offers the advantages of a much better quality cut at much lower pressures (in the order of 100 bar). At these lower pressures the water supply hoses remain flexible and hence more manageable, and there is minimal damage to the remaining pipework. The abrasive jet is also versatile enough to cut most other obstructions likely to be in the main pipe such as tree roots and bricks etc.

For such uses the entraining head must be made small and considerable effort has thus been directed towards the development of an abrasive water jet cutting system to operate in such confined areas, while maintaining adequate cutting performance at these relatively low pressures. The scope for this development is limited by the need for two separate feed lines, one for high pressure water and the other for abrasive material, and the need for a head of sufficient volume to accommodate apparatus for entraining the abrasive material into the jet formed by the high pressure water.

The present invention enables the abrasive to be entrained in the high pressure water remote from the cutting system so that only one feed line is required to the cutting head which can be of smaller size. According to the present invention there is provided a hopper for particulate materials comprising a body having a lower portion tapering towards its lower end, an outlet at said lower end and means for supplying fluid to the interior of said lower portion in a direction having a component along a wall of the lower portion. This component tends to excite a circulating flow of material around the tapered lower end of the hopper which combined with the force of gravity causes the material to spiral down to the outlet. The circulating flow tends to prevent blockages of the particulate material which might be caused by the reducing cross-section of the hopper towards the outlet.

Means may also be provided to supply fluid to an upper portion of the body so that the material contained within the hopper becomes a slurry which is more easily circulated by the fluid supplied to the interior of the lower portion as already described. The circulating flow of the abrasive material is facilitated when the lower portion is frusto-conical. The supply of fluid to the lower portion can assist the force of gravity when the direction of fluid supplied to the lower portion also has a component in the downward vertical direction. A particularly suitable means for supplying fluid to the lower portion comprises a tube lying parallel to a wall which defines the taper of the lower portion and also lying in a vertical plane with nozzles for directing jets of fluid having a component in the horizontal direction along the tapered wall and also having a component down the length of tube. A preferable inclination of the jets to the horizontal is at least 30°.

The hopper may be used in conjunction with a further supply of high pressure fluid, means being provided to entrain the slurry from the output of the hopper in the further supply of high pressure fluid.

An example of the invention will now be described with reference to the accompanying drawings in which.

Figure 1:
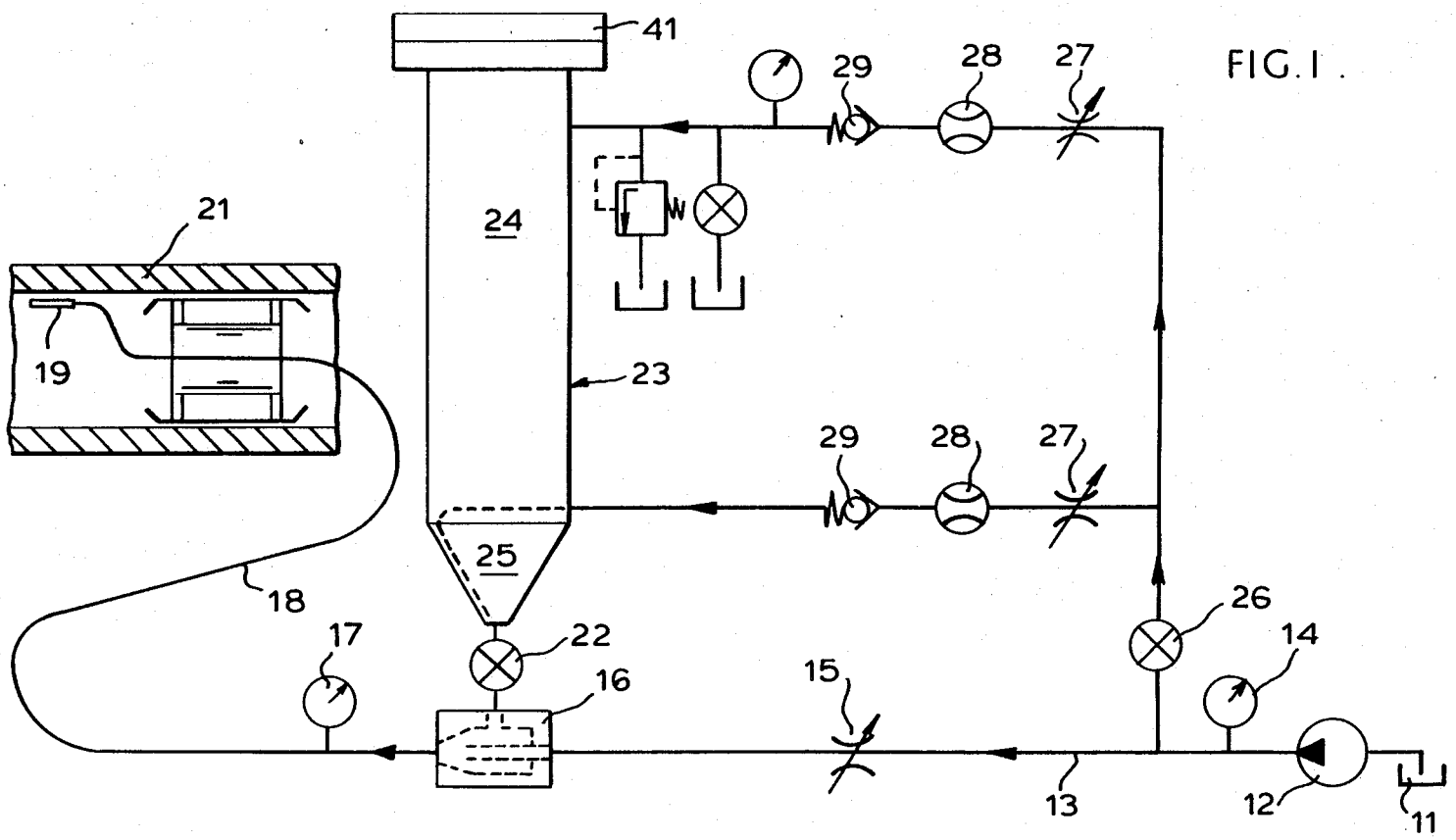
FIG. 1 is a schematic diagram of abrasive water jet cutting apparatus.

Water from reservoir 11 is forced by a conventional water jetting pump 12 along a supply tube 13 connected to a pressure gauge 14 through a variable valve 15 to an ejector 16. The outlet of the ejector 16 is connected to a further pressure gauge 17 and through a flexible conduit 18 to a nozzle 19 which is directed at the material to be cut away, in this case corrosion on the interior of a pipe 21. The ejector is fed with a slurry of abrasive material through a valve 22 from a supply 23.

Figure 2:
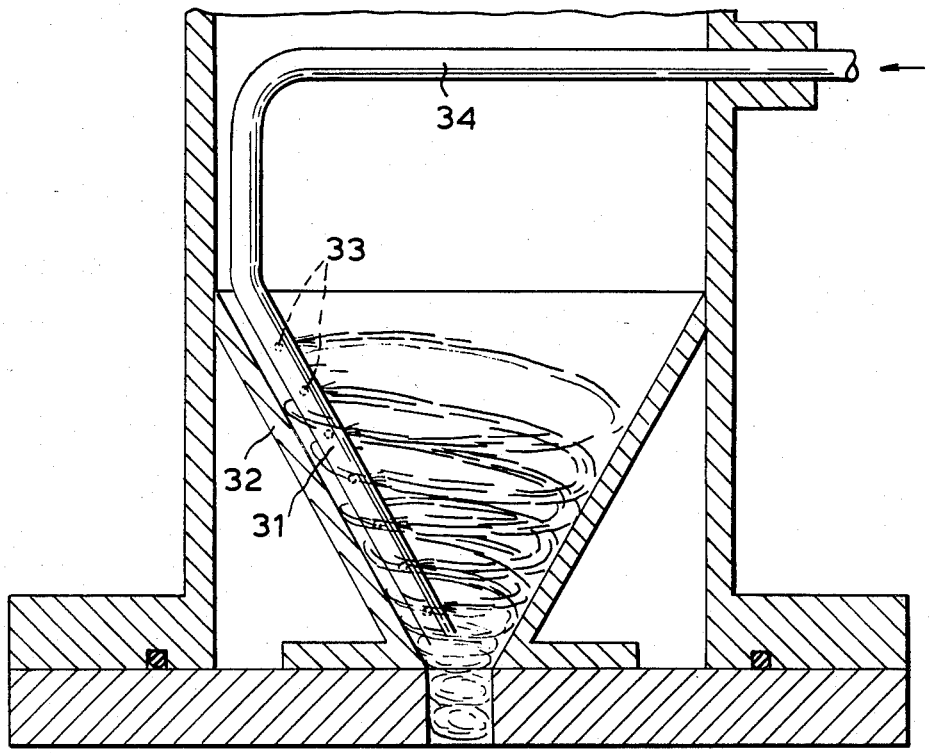
FIG. 2 is a part section, part side elevation of a detail of FIG. 1.

The supply 23 for abrasive material includes a hopper having an upper cylindrical portion 24 and a lower frusto-conical portion 25 whose outlet is connected through the valve 22 to the ejector 16. Water from the conduit 13 is bled off through a valve 26 to two parallel branches, each comprising a flow adjuster 27, flowmeter 28 and non-return valve 29. Fluid in the upper parallel branch is fed to the top region of a cylindrical portion 24 of the hopper to mix with the abrasive material to form a slurry. The water from the lower parallel branch is connected to a perforated tube 31, as can best be seen in FIG. 2, which lies parallel to the wall 32 of the frusto-conical portion 25 and in a vertical plane. Outlet passages 33 from the interior of the tube 31 are directed parallel to the wall 32 and inclined downwardly at least 30° to the horizontal. Water flowing through the passages 33 thus creates a circulating flow in the slurry because the passages are parallel to the wall 32. The passages also assist the downward movement of slurry under the force of gravity through their inclination to the normal to the axis of the tube 31. The precise angles of the taper of the lower portion 25 and of the inclination of the passages 33 can be adjusted to suit the materials and fluids in use. It is not necessary for the connecting conduit 34 from the lower parallel branch to the tube 31 to extend across the hopper as illustrated.

The quality of the slurry fed to the nozzle 19 can be controlled by relative adjustment of the two adjusters 27 and valve 15. Pressure gauges may be provided to monitor the quality.

Variations of the illustrated apparatus lie within the invention. For example, a plurality of tubes 31 can be provided. The half-angle of the cone of the frusto-conical portion can be other than the 30° illustrated. Since the output of the hopper 23 is already a slurry, it could be connected directly to the nozzle 19. When the slurry is to be mixed with further high pressure fluid from the conduit 13, a simple junction could be provided in place of the ejector 16. The pump 12 is conveniently arranged to pressurize the fluid to above 100 atmospheres when a high pressure feed system is required.

We claim:

1. A system for supplying a slurry, comprising a hopper body for particulate material, said hopper body having a main portion in communication with a lower portion that tapers toward an outlet at a lower end of said lower portion, and means supplying liquid to the interior of said lower portion along a wall of said lower portion and in a direction having a horizontal component, whereby said slurry is formed in said lower portion.

2. A system as claimed in claim 1, further comprising means for supplying additional liquid to said main portion of said hopper body.

3. A system as claimed in claim 1, wherein said lower portion of said hopper body is frusto-conical.

4. A system as claimed in claim 1, wherein said direction of liquid supply also has a downward vertical component.

5. A system as claimed in claim 4, wherein said direction of liquid supply is inclined at least 30° downward from horizontal.

6. A system as claimed in claim 1, further comprising means for mixing slurry output from said hopper body with pressurized carrier liquid.

7. A system as claimed in claim 6, wherein said mixing means comprises an ejector.

8. A system as claimed in claim 6, wherein said pressurized carrier liquid is water under pressure.

9. A system as claimed in claim 6, wherein said pressurized carrier liquid is supplied at a pressure of at least 100 atmospheres.

10. A system as claimed in claim 6, including means for adjusting flow of the liquid supplied to said lower portion of said body relative to flow of the carrier liquid to said mixing means.

11. A system as claimed in claim 10, including means for supplying additional liquid to said main portion of said body and means for adjusting flow of that liquid relative to the previously mentioned flows.

12. A system as claimed in claim 6, including a jetting-type cutting nozzle and means conveying said slurry from said mixing means to said cutting nozzle.

* * * * *